US007540435B2

(12) United States Patent
Mueller et al.

(10) Patent No.: US 7,540,435 B2
(45) Date of Patent: Jun. 2, 2009

(54) PRESSURE-EFFECTED INTERCONNECTION OF A METAL PART AND A PLASTIC PART

(75) Inventors: Martin Mueller, Moeglingen (DE); Elmar Okrent, Remseck (DE)

(73) Assignee: Robert Bosch GmbH, Stuttgart (DE)

( * ) Notice: Subject to any disclaimer, the term of this patent is extended or adjusted under 35 U.S.C. 154(b) by 320 days.

(21) Appl. No.: 10/590,617

(22) PCT Filed: Feb. 16, 2005

(86) PCT No.: PCT/EP2005/050687

§ 371 (c)(1),
(2), (4) Date: Aug. 24, 2006

(87) PCT Pub. No.: WO2005/085621

PCT Pub. Date: Sep. 15, 2005

(65) Prior Publication Data

US 2007/0181713 A1 Aug. 9, 2007

(30) Foreign Application Priority Data

Mar. 2, 2004 (DE) ..... 10 2004 010 174

(51) Int. Cl.
*F02M 51/00* (2006.01)

(52) U.S. Cl. ..... 239/585.5; 239/575; 239/585.1; 239/600

(58) Field of Classification Search ..... 239/533.3, 239/533.9, 575, 585.1, 585.4, 585.5, 600
See application file for complete search history.

(56) References Cited

U.S. PATENT DOCUMENTS

| | | | | |
|---|---|---|---|---|
| 4,938,193 | A | 7/1990 | Raufeisen et al. | |
| 5,238,192 | A | 8/1993 | McNair et al. | |
| 5,340,032 | A * | 8/1994 | Stegmaier et al. | 239/575 |
| 6,003,791 | A * | 12/1999 | Reiter | 239/585.5 |
| 6,547,154 | B2 * | 4/2003 | Dallmeyer et al. | 239/900 |

FOREIGN PATENT DOCUMENTS

| | | |
|---|---|---|
| JP | 03 121254 | 5/1991 |
| WO | WO 98/22707 | 5/1998 |

OTHER PUBLICATIONS

Patent Abstracts of Japan, vol. 015, No. 321 (M-1147), Aug. 15, 1991.

* cited by examiner

*Primary Examiner*—Steven J Ganey
(74) *Attorney, Agent, or Firm*—Kenyon & Kenyon LLP

(57) ABSTRACT

A pressure-effected interconnection of a metal part and a plastic part which is slipped over the metal part with a press fit, in particular in a fuel injector for internal combustion engines, is provided in which, for a reliable connection between the pressing pieces, without high demands on manufacturing tolerances, the outer wall of the metal part has circumferential ribs disposed one behind the other in the axial direction, with a back that rises from the outer wall towards the outside in the slide-on direction of the plastic part, and a flank that falls steeply from the back to the outer wall. Each rib has disposed in front of it—viewed in the slide-on direction of the plastic part—an annular groove, the annular groove being introduced into the outer wall, directly at the foot of the back.

11 Claims, 2 Drawing Sheets

PRESSURE-EFFECTED INTERCONNECTION OF A METAL PART AND A PLASTIC PART

FIELD OF THE INVENTION

The present invention relates to a pressure-effected interconnection of a metal part and a plastic part which is slipped over the metal part with a press fit, in particular in a fuel injector for internal combustion engines.

BACKGROUND INFORMATION

In a conventional fuel injector, shown in FIG. 1 in longitudinal section, a fuel filter 3 is held by a press fit on a metallic valve housing 1 and a metallic valve body 2 which axially projects from valve housing 1. Fuel filter 3 has a cup-shaped base element 4 which is made of plastic and has four cup sections, 4*a*, 4*b*, 4*c*, 4*d*, whose inner diameters are graduated with respect to each other. Upper cylindrical cup section 4*a*, having the largest inner diameter, is slipped over valve housing 1 with a press fit. Second cylindrical cup section 4*b*, contiguous thereto and having a reduced inner diameter, surrounds the upper region of valve body 2 with a radial clearance and has a wall opening 5 into which a filter mesh 6 is inserted in each case. Third cup section 4*c*, contiguous to second cup section 4*b*, tapers conically and, at its lower end, transitions into cylindrical fourth cup section 4*d* which sits on valve body 2 with a press fit. In the region of conical third cup section 4*c*, radial inflow ducts 7 are formed in valve body 2, which discharge into a central valve chamber 8 on one side and at the outer wall of valve body 2 on the other side, where they form an intake opening 9 for the fuel flow to valve chamber 8. The other components of the fuel injector such as valve needle 10 which, together with a valve seat 11, releases or seals a spray-discharge orifice 12 in valve chamber 8, solenoid 13 to actuate valve needle 10, and valve-closure spring 14 are well known, for example from Bosch Kraftfahrtechnisches Taschenbuch, [Automotive Handbook] 23$^{rd}$ edition, 1999, pages 473 and 476, so that there is no need to discuss them further.

In order to achieve appropriate clamping between the valve housing and valve body on one side and the plastic filter on the other side, and also reliable mounting, close tolerances of the parts to be interconnected by compression must be observed, and the plastic part must be subjected to special conditioning. If the compression is too high, the plastic base element of the fuel filter may be damaged or destroyed during the pressing-on operation. If the compression force is too low, the filter may detach easily since the base element made of plastic has a different thermal expansion coefficient than the metal of valve housing and valve body. Swelling of the plastic may also cause expansion of the base element so that the water content of the plastic must be adjusted to a specific value by conditioning the plastic base element.

SUMMARY

A pressure-effected interconnection of a metal part and a plastic part according to an example embodiment of the present invention may have the advantage that it requires no close manufacturing tolerances between the two parts to be pressed together, and that a reliable press fit of the plastic part on the metal part as well as reliable assembly are guaranteed under all operating conditions, also without special conditioning specifications having to be observed for the plastic part. Shavings possibly peeling off the plastic part during compression are caught in the annular grooves sunk into the wall of the metal part at the foot of the ribs, and are unable to squeeze between the contact surfaces of the pressing pieces, thereby bringing about an undefined pressing surface. The force characteristics during the assembly, i.e., the slide-on force, is constant across a longer production period and exhibit only slight variances, which makes them easy to monitor.

According to an advantageous embodiment of the present invention, the ribs situated one behind the other are formed such that their projection height beyond the wall of the metal part—viewed transversely to the slide-on direction of the plastic part—increases in the slide-on direction of the plastic part, that is to say, the first rib lying closer to the plastic part in the slide-on direction has a lower projection height than the last rib lying at a greater distance from the plastic part in the slide-on direction. This design of the ribs ensures a slow increase in the compression when the plastic part is slipped over the metal part.

A fuel valve, in particular a fuel injector for internal combustion engines, is also provided, where the pressure-effected interconnection according to the present invention is established between the valve body representing a metal part and a fuel filter representing a plastic part.

BRIEF DESCRIPTION OF THE DRAWINGS

The present invention is explained in greater detail in the following description on the basis of an exemplary embodiment shown in the figures.

DETAILED DESCRIPTION OF EXAMPLE EMBODIMENT

Figure 1:
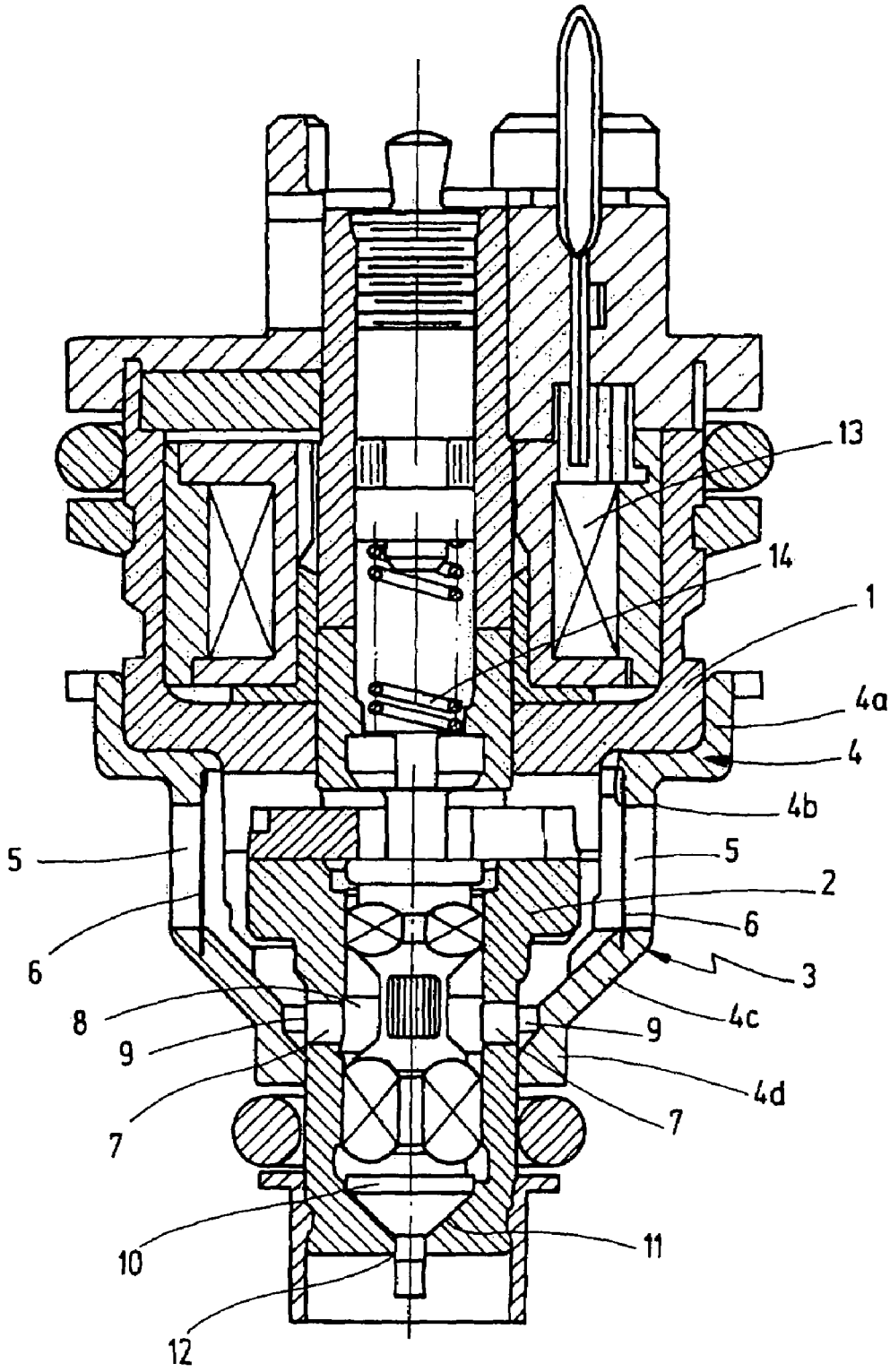
FIG. 1 shows a longitudinal section of a conventional fuel injector.

The pressure-effected interconnection of a metal part and a plastic part slid over the metal part with a press fit is described in the following with the aid of a fuel injector for internal combustion engines on whose metallic valve body 22 a fuel filter 23 made of plastic is held with a press fit. The fuel injector shown only in a cutaway view in FIG. 2 in a longitudinal section has a cylindrical valve body 22 in which a valve chamber 28 and at least one inflow duct 27 for the supply of fuel into valve chamber 28 are formed. Inflow ducts 27, of which only one can be seen in FIG. 1, discharge into valve chamber 28 on one side and have an inflow opening 29 in the outer wall of cylindrical valve body 22 on the other side. While not shown further, but matching the fuel injector according to FIG. 1, valve chamber 28 has a valve opening, or spray bore, which is enclosed by a valve seat. Valve needle 30, shown in a cutaway portion in FIG. 2, dips into valve chamber 28 and—as in FIG. 1—is pressed onto the valve seat by a valve-closure spring, thereby closing the valve opening. As in FIG. 1, valve needle 30 is actuated by a solenoid, which in response to being supplied with an excitation current lifts valve needle 30 off the valve seat, counter to the force of the valve-closure spring, so that the valve opening is released and fuel is spray-discharged from valve chamber 28. The solenoid is in turn accommodated in valve housing 21. Valve body 22 is inserted into valve housing 21 from below and connected to valve housing 21 in the region of a valve-body section having a larger diameter in a fluid-tight manner by a circumferential welded seam 31. In the process, an annular chamber 32 into which inflow ducts 27 discharge by way of their inflow openings 29 is produced between inner wall 211 of valve housing 21 and cylinder wall 221 of valve body 22. The fuel flow to valve chamber 28 is implemented via annular chamber 32 and inflow ducts 27.

Fuel filter 23 has a hollow-cylindrical base element 24 made of plastic whose inside diameter is slightly larger than the outer diameter of valve body 22. Wall cutouts, i.e., traversing wall openings 25 via which inflow ducts 27 are connected to annular chamber 34, are introduced into base element 24. Each wall opening 25 is covered by a filter mesh 26. Fuel filter 23 is slid over valve body 22 in the direction of arrow 33.

To achieve a reliable, tight press fit of fuel filter 23 on valve body 22 without high demands on the manufacturing tolerances of both components, a plurality of circumferential ribs—in this case, three ribs 34, 35, 36—have been formed on cylinder wall 221 of valve body 22, which are arranged one behind the other in the axial direction of valve body 22, i.e., in slide-on direction 33 of fuel filter 23. Each circumferential rib 34, 35, 36 has a back 37 which radially rises in slide-on direction 33 of fuel filter 23, and a flank 38 which sharply falls from the back end, radial flank 38 extending radially in the exemplary embodiment of FIG. 2. As can be seen from FIG. 2, the radial projection height of ribs 34, 35, 36 increases in slide-on direction 33 of fuel filter 23, so that first rib 34 has the smallest projection height and thus the smallest radial measure of flank 38, and last rib 36 has the greatest projection height and thus the greatest radial measure of flank 38. Situated in front of each rib 34, 35, 36 in slide-on direction 33 of fuel filter 23 is an annular groove 39, which is introduced into cylinder wall 221 directly at the foot of back 37.

During installation fuel filter 23 is pressed over ribs 34 through 36 by its base element 24 made of plastic. The pressing over of ribs 34 through 36 is facilitated by the angled slope of back 37. The stepped increase in the projection measure of ribs 34 through 36 beyond cylinder wall 221 ensures a slow increase in the pressure. The pressure itself acts directly on ribs 34 through 36, as line contact and not across the full pressure path, which causes base element 24 to deform slightly. In addition, base element 24 is subjected to a locally high line pressure, which is more advantageous for the plastic base element than cylindrical loading. When fuel filter 23 is completely pressed onto valve body 22, base element 24 interlocks with ribs 34 through 36. Shavings and scrapings of plastic that may detach when base element 24 is pressed on may collect in annular grooves 39 at the foot of back 37 of ribs 34 through 36 and will not be pushed toward the outside. This also prevents the plastic shavings or splinters from being pushed through the gap between base element 24 and valve body 22 so that they do not become wedged there. They are also unable to reach the area of inflow ducts 27 and be washed into the valve seat region by the fuel via inflow ducts 27.

Figure 2:
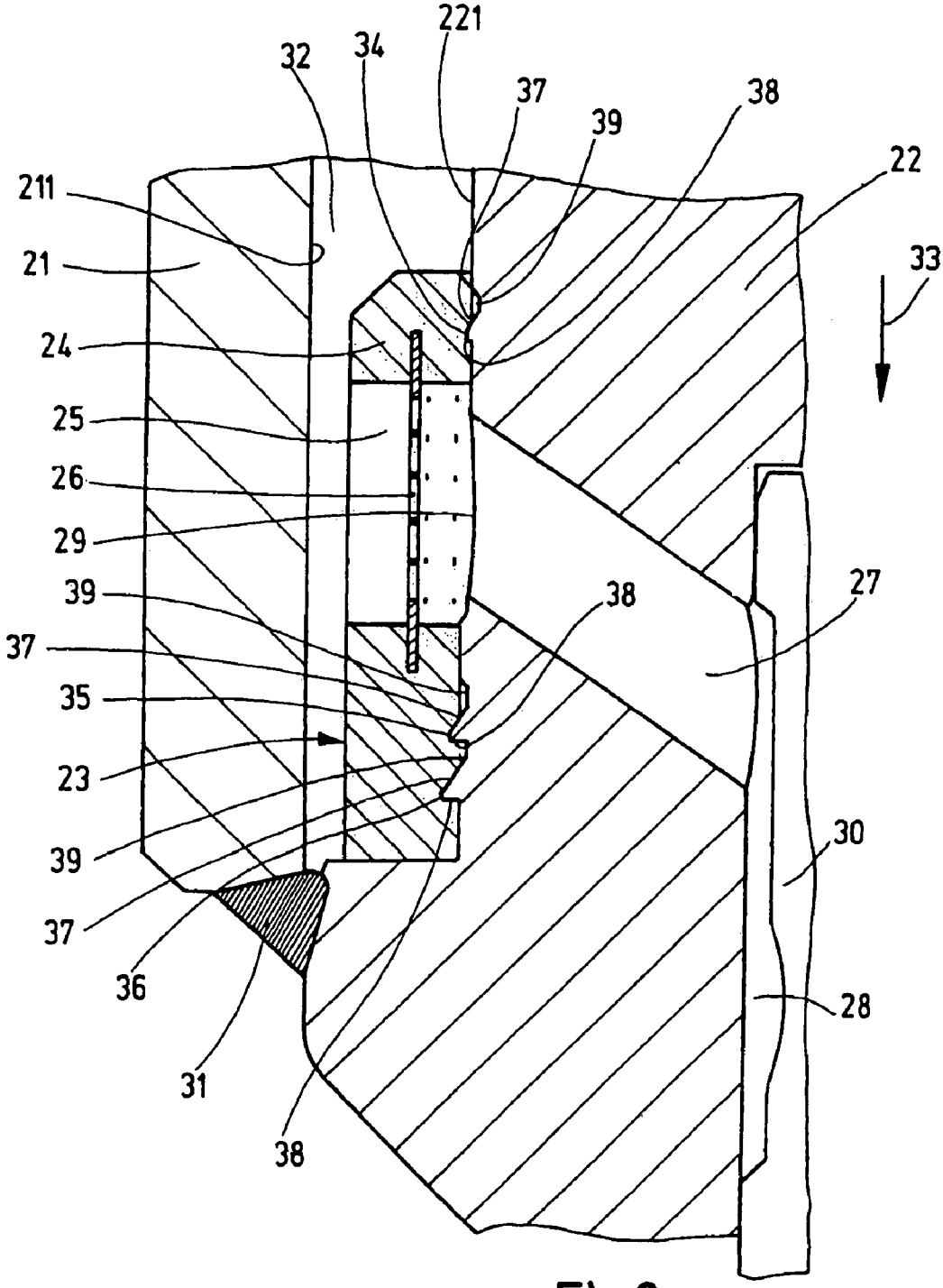
FIG. 2 shows a longitudinal section of a fuel injector according to an example embodiment of the present invention in a cutaway view.

The present invention is not limited to the exemplary embodiment of a fuel injector shown and described in FIG. 2. It is also possible to implement the press fit between fuel filter 23 according to FIG. 1 on the one side, and valve housing 1 and valve body 2 on the other side, in the manner described.

The pressure-effected interconnection according to the present invention of a metal part and a plastic part slid over the metal part with a press fit, which was described using the example of a fuel injector, may generally be used for any plastic-metal part interconnection.

What is claimed is:

1. A device, comprising:

a metal part; and a plastic part slid over the metal part with a press fit and forming a pressure-effected interconnector therewith;

wherein the metal part has;

an outer wall with circumferential ribs, the ribs being arranged in a sawtooth-shaped arrangement one behind the other in an axial direction, each rib having a respective back which outwardly rises in a slanted manner from a surface of the outer wall in a slide-on direction of the plastic part and a respective flank which sharply falls from an end of the respective back perpendicularly toward the surface of the outer wall; and in front of each rib viewed in the slide-on direction of the plastic part, a respective annular groove situated in the outer wall directly at a foot of the respective back of the respective rib.

2. A device, comprising:

a metal part; and a plastic part slid over the metal part with a press fit and forming a pressure-effected interconnector therewith;

wherein:

the metal part has an outer wall with circumferential ribs, the ribs being arranged one behind the other in an axial direction, each rib having a respective back which outwardly rises from the outer wall in a slide-on direction of the plastic part, and a flank which sharply falls from a back end toward the outside wall, the metal part further having an annular groove located in front of each rib viewed in the slide-on direction of the plastic part, the outer groove being situated in the outer wall directly at a foot of the respective back; and a projection height of the ribs beyond the outer wall of the metal part, viewed transversely to the slide-on direction, increases from rib to rib in the slide-on direction of the plastic part.

3. The device as recited in claim 2, wherein the metal part and the plastic part have a cylindrical form, and an inner diameter of the plastic part is slightly larger than an outer diameter of the metal part.

4. The device as recited in claim 3, wherein the metal part is a valve body of a fuel valve, and the plastic part is a base element, made of plastic, of a fuel filter, which covers an inflow opening of at least one fuel inflow duct formed in the valve body by a filter mesh.

5. The device according to claim 4, wherein the fuel valve is a fuel injector.

6. A fuel valve for an internal combustion engine, comprising:

a cylindrical valve body, having at least one fuel inflow duct which is formed in the valve body having an inflow opening situated in a wall of the cylinder body; and a fuel filter coupled to the cylindrical valve body and retained thereto by a press fit, the fuel filter having a hollow-cylindrical base element made of plastic and filter mesh which is embedded in the base element and covers the inflow openings, the base element of the fuel filter having a shape and being configured to be slid over the valve body;

wherein:

the valve body has circumferential ribs disposed on a cylinder wall thereof, the ribs being disposed in a sawtooth-shaped arrangement one behind the other in an axial direction, each of the ribs having a respective back which rises outwardly in a slanted manner from a surface of the cylinder wall in a slide-on direction of the fuel filter and a respective flank which steeply falls from an end of the respective back perpendicularly to the surface of the cylinder wall; and disposed in front of each of the ribs in the slide-on direction of the fuel filter is a respective annular groove situated into the cylinder wall of the valve body directly at a foot of the respective back of the respective rib.

7. A fuel valve for an internal combustion engine, comprising:

a cylindrical valve body, having at least one fuel inflow duct which is formed in the valve body having an inflow opening situated in a wall of the cylinder body; and fuel filter coupled to the cylindrical valve body and retained thereto by a press fit, the fuel filter having a hollow-cylindrical base element made of plastic and filter mesh which is embedded in the base element and covers the inflow openings, the base element of the fuel filter having a shape and being configured to be slid over the valve body;

wherein:

the valve body has circumferential ribs disposed on a cylinder wall thereof, the ribs being disposed one behind the other in an axial direction, each of the ribs having a back which rises outwardly from the cylinder wall in the slide-on direction of the fuel filter, and having a flank which steeply falls from a back end to the cylinder wall;

and wherein an annular groove is disposed in front of each of the ribs in the slide-on direction of the fuel filter, the groove being situated into the cylinder wall of the valve body directly at a foot of the back; and a radial projection height of the ribs beyond the cylinder wall increases from rib to rib in the slide-on direction of the fuel filter.

8. The fuel valve according to claim 7, wherein the fuel valve is a fuel injector.

9. The fuel valve as recited in claim 7, wherein an inner diameter of the base element of the fuel filter is slightly larger than an outer diameter of the valve body.

10. The fuel valve as recited in claim 7, wherein the base element of the fuel filter has a number of traversing wall openings, each of which is sealed by the filter mesh.

11. The fuel valve as recited in claim 7, wherein a valve housing is situated on top of the valve body and connected thereto in a fluid-tight manner, the valve housing enclosing the base element of the fuel filter with a radial clearance allowing a flow of fuel.

* * * * *